US005944251A

United States Patent [19]

LaFleur

[11] Patent Number: 5,944,251

[45] Date of Patent: Aug. 31, 1999

[54] FORM FIT CONTAINER LINER

[75] Inventor: Lee LaFleur, Manistee, Mich.

[73] Assignee: Custom Packaging Systems, Inc., Manistee, Mich.

[21] Appl. No.: 09/003,621

[22] Filed: Jan. 7, 1998

[51] Int. Cl.[6] ..... B65D 30/18; B65D 5/60

[52] U.S. Cl. ..... 229/117.35; 220/495.11; 383/104; 383/107; 383/121; 383/122

[58] Field of Search ..... 229/117.35; 220/495.11, 220/495.06, 495.08, 495.09, 495.1; 383/104, 121, 122, 107, 108

[56] References Cited

U.S. PATENT DOCUMENTS

| | | | |
|---|---|---|---|
| 3,381,886 | 5/1968 | Goglio | 383/121 |
| 3,739,977 | 6/1973 | Shapiro et al. | 383/104 |
| 4,171,764 | 10/1979 | Schonback et al. | 383/121 |
| 4,512,136 | 4/1985 | Christine | 383/121 |
| 4,759,642 | 7/1988 | Van Erden et al. | 383/63 |
| 5,148,940 | 9/1992 | Mendise | 220/495.11 |
| 5,425,468 | 6/1995 | Birkel et al. | 220/495.11 |

FOREIGN PATENT DOCUMENTS

| | | | |
|---|---|---|---|
| 6255657 | 9/1994 | Japan | 383/104 |

*Primary Examiner*—Stephen P. Garbe
*Attorney, Agent, or Firm*—Reising, Ethington, Barnes, Kisselle, Learman & McCulloch, P.C.

[57] ABSTRACT

A form fit liner for a container has a bottom wall and at least one sidewall formed of at least one layer of a flexible material, at least one heat seal joining two adjacent portions of material of the sidewall and extending from the bottom wall towards the upper edge of the liner to define a reduced cross-sectional area lower portion of the liner constructed to be received within the container and an upper liner portion having a greater cross-sectional area than the lower portion constructed to extend out of the container to isolate the container from its contents as the liner is filled and emptied. The upper portion of the liner which extends above the container can surround a fill tube used to dispense a liquid product into the liner of the container to shield the container from the splashing or sloshing of the liquid product as the container is being filled. If desired, the upper portion may be folded down over a portion of the outside of the container to similarly isolate the container from the contents thereof as the container is filled or emptied. The increased cross-sectional area of the upper portion facilitates folding the upper portion over the container, and especially over insulated containers, such as those used for ice cream, which have a significant wall thickness.

11 Claims, 5 Drawing Sheets

FORM FIT CONTAINER LINER

FIELD OF THE INVENTION

This invention relates generally to shipping and storage containers and more particularly to a flexible liner for such containers.

BACKGROUND OF THE INVENTION

Flexible liners having a generally cubical configuration have been previously used for various shipping and storage containers. Typically, these liners have four sidewalls, a bottom wall interconnecting the sidewalls and optionally may have a top defining an enclosure with a spout or an access opening through one or both of the top and bottom walls to facilitate filling and emptying the liner. Such liners may be received within or surrounding a container to prevent leakage of the contents of the container and to prevent contaminants from entering the container.

Current liners are typically of approximately the same dimension as the container with which they are used and, especially when received within the container, provide little protection to the exterior of the container as it is being filled. Thus, when pouring a liquid into an inner liner of a cardboard box for example, splashing, sloshing or overfilling of the liquid within the liner can ruin the cardboard box. To further protect the container it is desirable in some instances to fold the liner over the upper edge of the container at least when filling and emptying the container. This is difficult, if not impossible, to do when the liner has a smaller cross-sectional area than the outside of the container which is especially true with insulated containers, such as used for ice cream, which may have a wall thickness of 1½ inches or more. Also, current liners are not readily adaptable to various container configurations such as square, rectangular or round or cylindrical and usually result in a reduction of the effective volume of the container due to the excess material of the liner stuffed into the container and the resulting poor fit of the liner within the container. The excess material may also become folded in the container and thereby trap some of the contents of the liner therein preventing the liner from being completely emptied and wasting a portion of the contents. Further, the liner may become bunched up or snagged within the container which may result in high stresses on portions of the liner which can reduce the reliability and even rupture the liner in use.

SUMMARY OF THE INVENTION

A form fit liner for a container has a bottom wall and at least one sidewall formed of at least one layer of a flexible material, at least one heat seal joining two adjacent portions of material of the side wall and extending from the bottom wall towards the upper edge of the liner to define a reduced cross-sectional area lower portion of the liner constructed to be received within the container and an upper liner portion having a greater cross-sectional area than the lower portion constructed to extend out of the container to isolate the container from its contents as the liner is filled and emptied. The upper portion of the liner which extends above the container can surround a fill tube used to dispense a liquid product into the liner of the container to shield the container from the splashing or sloshing of the liquid product as the container is being filled. If desired, the upper portion may be folded down over a portion of the outside of the container to similarly isolate the container from the contents thereof as the container is filled or emptied. The increased cross-sectional area of the upper portion facilitates folding the upper portion over the container, and especially over insulated containers, such as those used for ice cream, which have a significant wall thickness.

The reduced cross-sectional lower portion of the liner fits more closely in the container than would a liner having a uniform, consistent cross sectional area stuffed into the smaller cross sectional area of the interior of the container. This reduces the likelihood of the liner becoming snagged when inserted into the container or rupturing or bulging due to its being bunched up or pinched within the container. The form fit liner works well with containers having square, rectangular or circular cross sections.

Objects, features and advantages of this invention include providing a container liner which has an enlarged cross sectional area upper portion to protect the container as it is being filled or emptied, has a form fit lower portion constructed to be received in a similar size container, facilitates folding the upper portion of the liner over the exterior of the container to protect the container, can be used with a wide variety of containers of various sizes and shapes, facilitates filling and completely emptying a container, facilitates loading a liner into a container, is less likely to become snagged or bunched-up when inserted into a container, is of relatively simple design and economical manufacture and construction, is reliable and durable and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
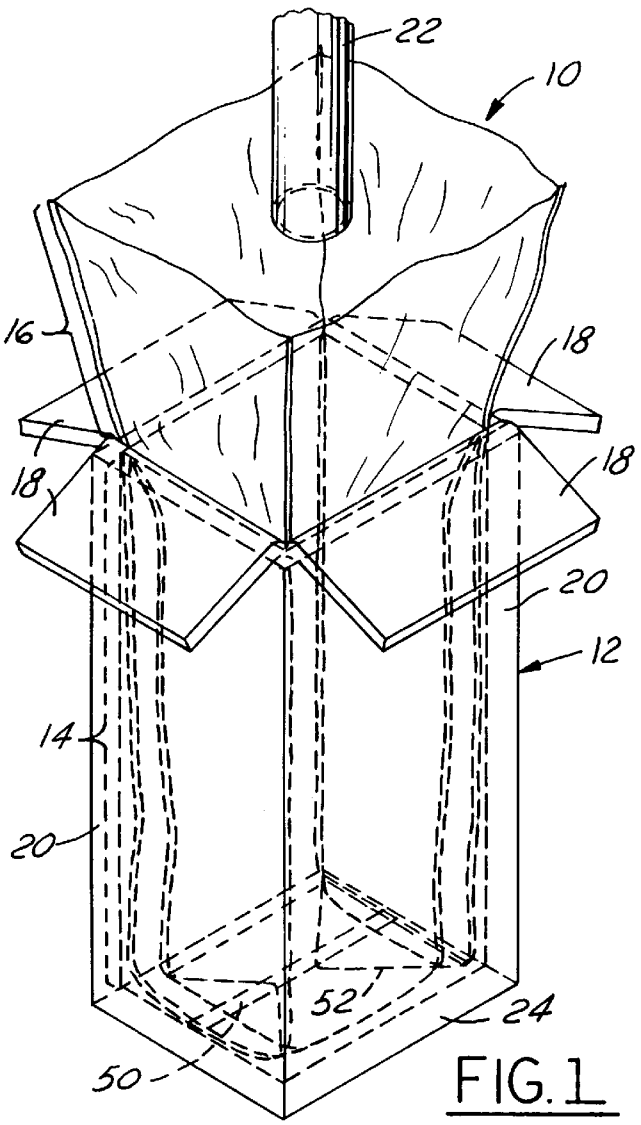
FIG. 1 is a perspective view illustrating a form fit liner embodying this invention and received within a generally rectangular container.

Referring in more detail to the drawings, FIG. 1 illustrates a form fit liner 10 for a container 12 and having a reduced cross-sectional area lower portion 14 received within the container 12 and an upper portion 16, having a greater perimeter and cross sectional area than that of the lower portion 14. The upper portion 16 extends out of the container 12 and is constructed to protect the container 12 from any splashing or sloshing of the contents of the liner 10 as it is being filled or emptied. The upper portion 16 of the liner 10 may be folded down over flaps 18 on the container or over a portion of the sidewall 20 of the container 12, if no flaps 18 are present, to protect the container 12 as it is being filled or emptied. Alternatively, the upper portion 16 may remain extended above the container 12 to surround a fill tube 22 through which flowable material is discharged into the container 12 to isolate the container 12 from its contents as it is being filled and/or emptied.

Figure 9:
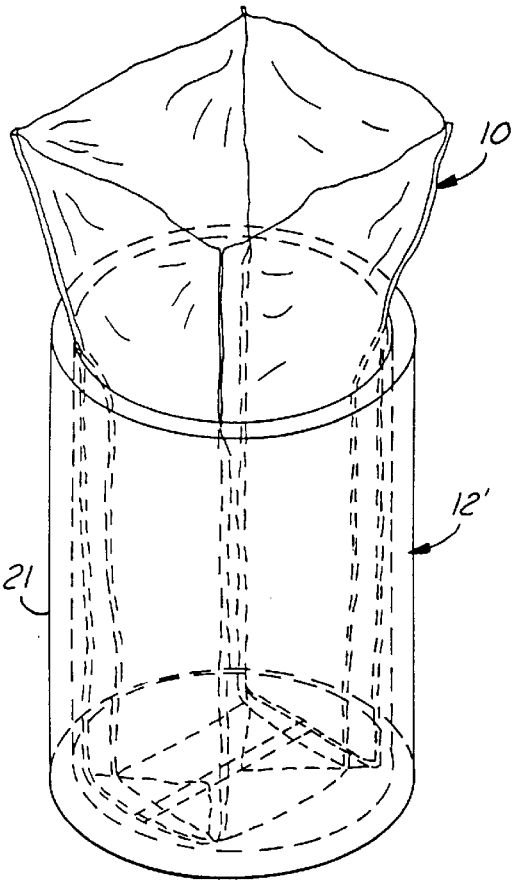
FIG. 9 is a perspective view illustrating a liner according to the first embodiment of the invention received within a cylindrical container.

The container 12 may be generally cubical with square or rectangular sidewalls 20 (FIG. 1) or it may be a cylindrical container 12' (FIG. 9) with a circular side wall 21. The containers 12 and 12' may be made of various materials including but not limited to plastic, card board, and the like, and may be used to ship or store hot or cold liquids including soups and various sauces as well as ice cream and other frozen or semi-frozen products. With some products an insulated container is desirable to reduce melting of the product, such as when used with ice cream. These containers may have a significant wall thickness, typically on the order of 1½ inches thick, providing a significant difference between the interior and exterior perimeter or cross-sectional areas of the container 12.

As shown in FIGS. 1–8, a liner 10 according to a first embodiment of this invention is generally complimentary shaped to an insulated container 12 having four rectilinear sidewalls 20 and a bottom wall 24 and preferably four flaps 18 which may be folded to close the upper end of the container 12. The liner 10 is desirably circumferentially continuous, is preferably formed from a seamless tubular blank 26 and has an open upper end 30, four generally rectilinear sidewalls 32 and a bottom wall 34 closing the lower end and interconnecting the sidewalls 32. Each sidewall 32 has an upper edge 36, lower edge 38 and a pair of generally opposed side edges 40. Each side edge 40 is defined as the juncture between adjacent sidewalls 32. The liners 10 are peferably formed of a material impervious to liquids and to the contents of the container 12 to prevent leakage and to prevent contaminants from entering the contents of the liner 10. For example, the liners 10 may be made from a plastic film such as polyethylene or polypropylene plastic films with a thickness in the range of about 1–10 mil. per layer.

Figure 3:
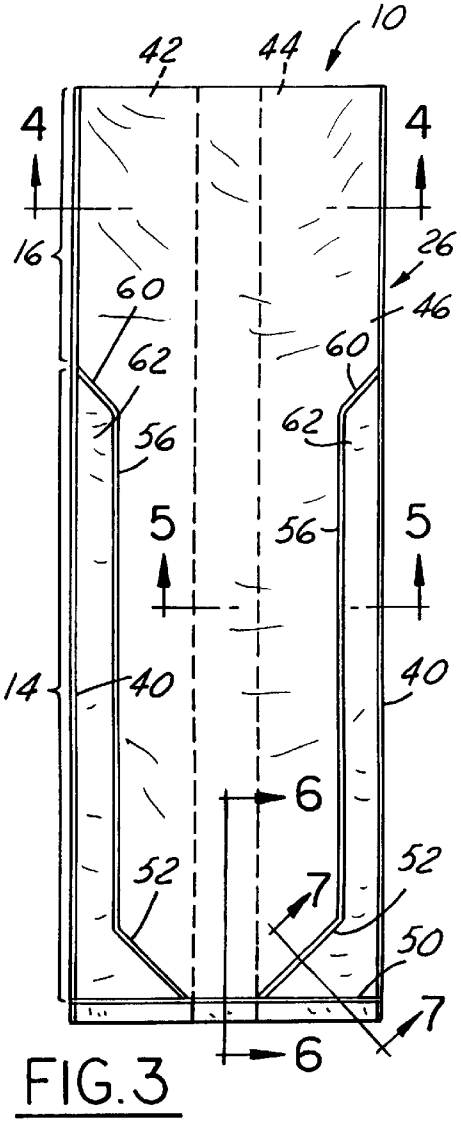
FIG. 3 is a side view of the liner folded flat.
Figure 2:
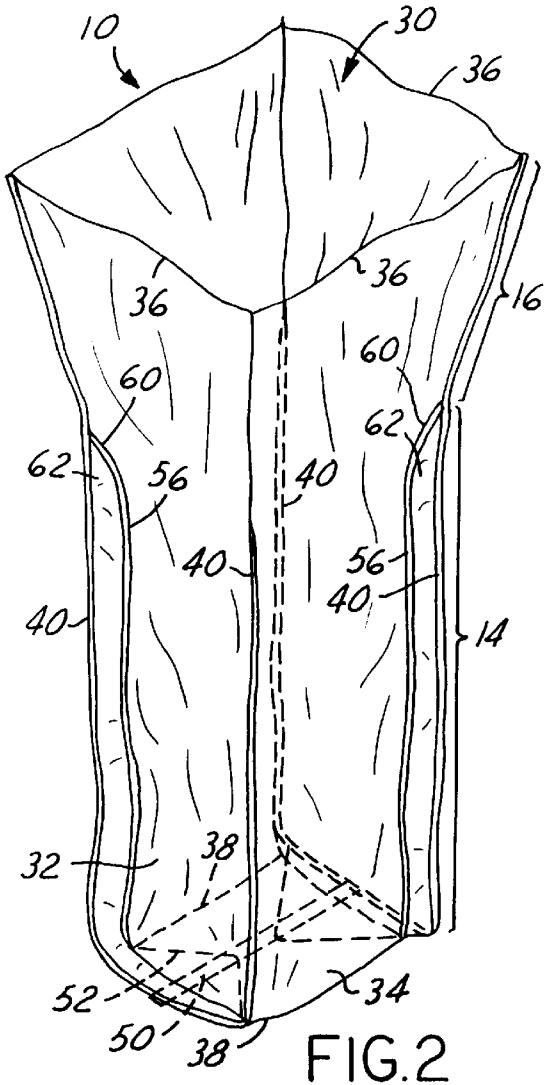
FIG. 2 is a perspective view of the liner of FIG. 1.
Figure 4:
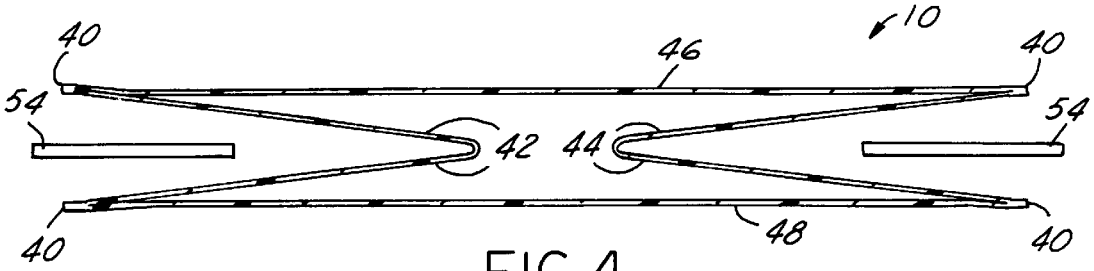
FIG. 4 is a cross sectional view taken along line 4—4 of FIG. 3.
Figure 6:
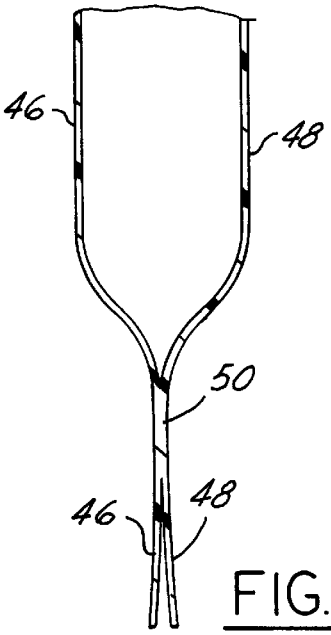
FIG. 6 is a cross sectional view taken along line 6—6 of FIG. 3.
Figure 7:
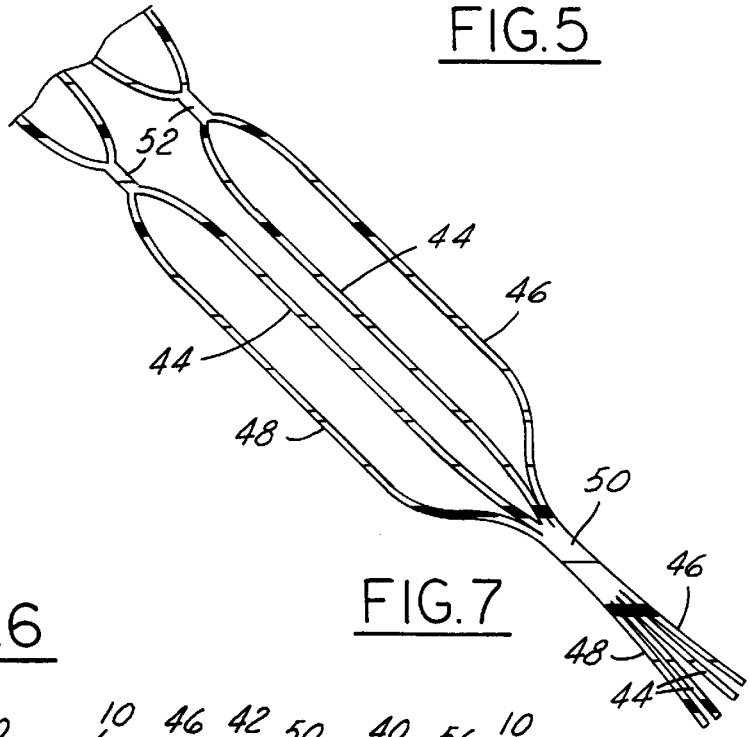
FIG. 7 is a cross sectional view taken along line 7—7 of FIG. 3.

The bottom wall 34 is preferably integrally formed with the sidewalls 32. To form the bottom wall 34, the blank 26 forming the liner 10 is preferably folded flat as shown in FIGS. 3 and 4 has a pair of gusseted panels 42, 44 received between a pair of overlying, flat panels 46, 48. To close the bottom, all of the panels 42–48 are then heat sealed together along a generally straight line 50 adjacent the lower edge of the blank 26 to seal the lower end of the liner 10 as best shown in FIGS. 3 and 6. To provide a bottom wall 34 which is generally rectangular when the liner 10 is expanded, each overlying flat panel 46, 48 is heat sealed to its adjacent gusseted panels 42, 44 along the canted lines 52 shown in FIGS. 3 and 7 which may extend all the way to the side edges 40 of the flat panels 46, 48. Thus, when expanded the bottom wall 34 has a generally rectangular configuration which is complementarily shaped to the interior of the bottom wall 24 of the container 12. Preferably, as shown in FIG. 4, to prevent each gusseted panel 42, 44 from being heat sealed to itself when the canted heat seal lines 52 are formed, an insulating plate 54, or an insulating layer of material having low thermal conductivity, such as Teflon, is disposed within each gusseted panel 42, 44 when the heat seals 52 are formed.

Figure 5:
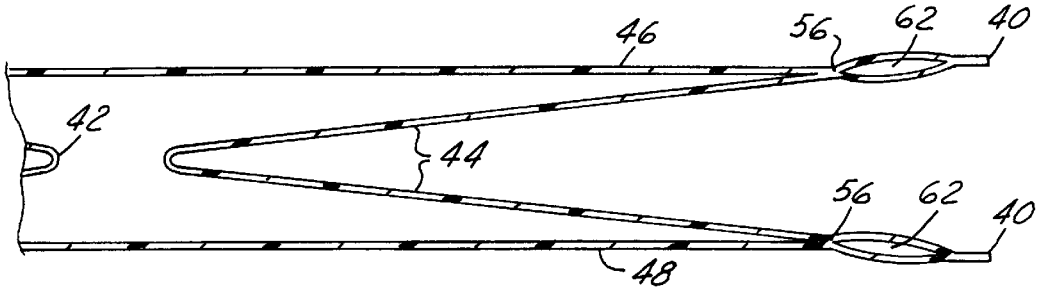
FIG. 5 is a cross sectional view taken along line 5—5 of FIG. 3.
Figure 8:
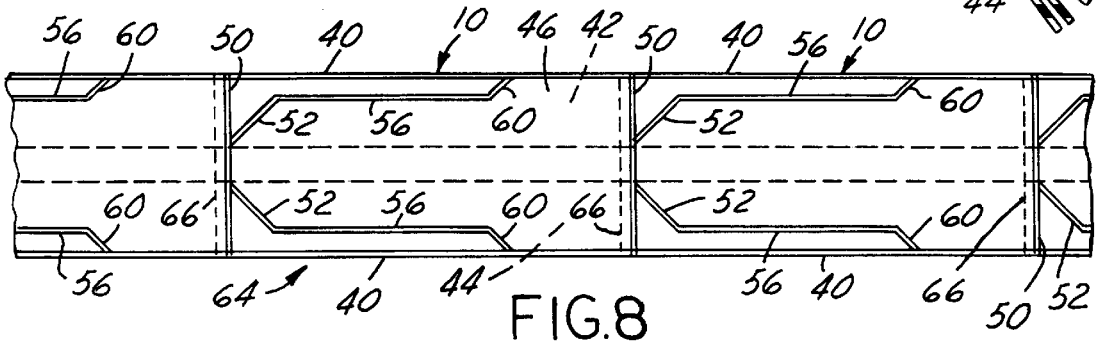
FIG. 8 is a plan view of a roll of liners illustrating the liners connected in end-to-end relation with a perforated line separating adjacent bags.

To form the reduced perimeter or cross sectional area lower portion 14 of the liner 10 which is received within the container 12, the liner 10 is heat sealed along lines 56 as best shown in FIGS. 3 and 5, to connect each flat panel 46, 48 to its adjacent gusseted panels 42, 44 at a location spaced inboard of and generally parallel to each juncture or side edge 40 between the flat panels 46, 48 and gusseted panels 42, 44. These heat seal lines 56 may be formed at the same time that the canted lines 52 of the bottom wall 34 are formed. A transitional heat seal portion 60 extends from the heat seal lines 56 to the side edges 40 of the sidewalls 32 of the liner 10 and defines an enclosure 62 isolated from the interior of the liner 10 between the heat seal lines 56 and the side edge 40 which is excess material and may be removed if desired. Preferably, as shown in FIG. 8, the liners 10 are formed on an elongate web 64 of material providing a generally continuous roll of liners 10 with adjacent liners 10 connected in end to end relation separated by a perforated line 66 defining the upper edge 36 of the sidewalls 32 and along which individual liners 10 may be removed or separated from the web 64 or roll of liners 10.

Figure 10:
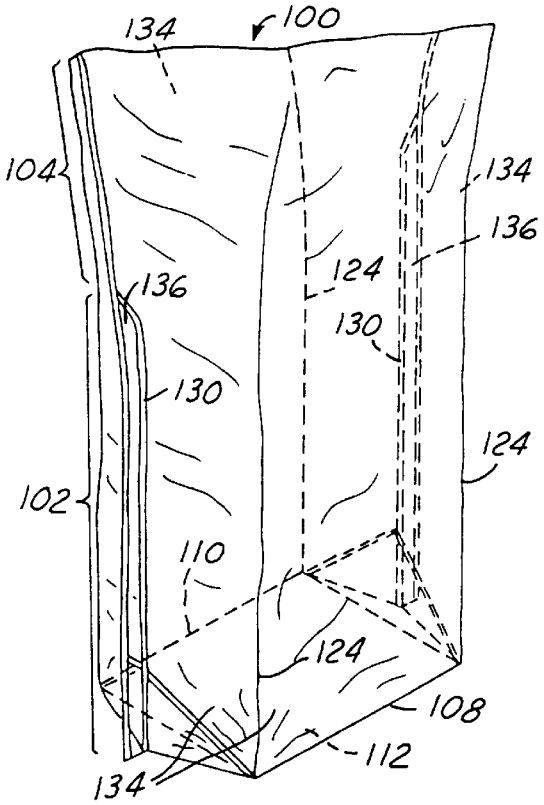
FIG. 10 is a partial perspective view of a second embodiment of a liner of this invention.
Figure 11:
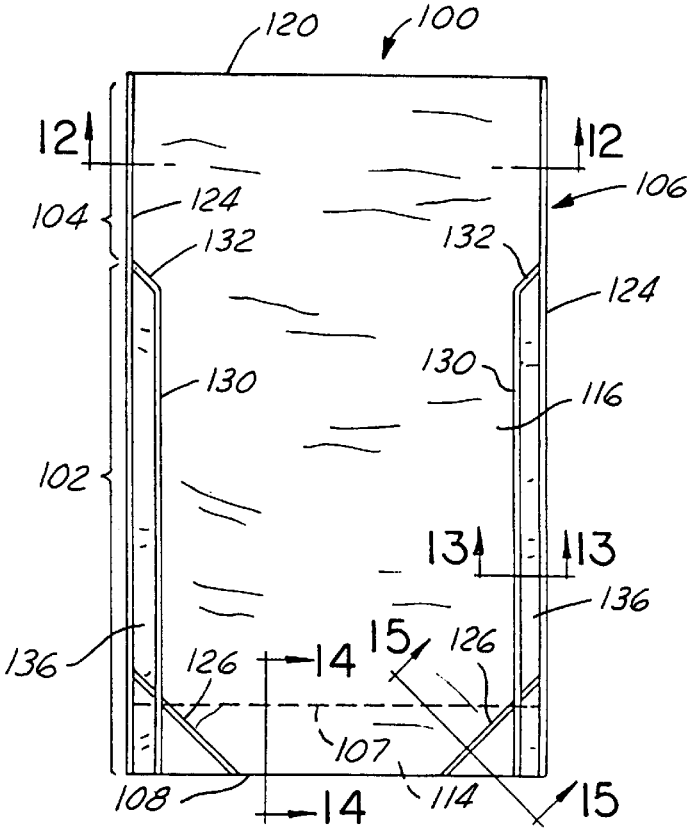
FIG. 11 is a side view of the liner of FIG. 9.
Figure 12:
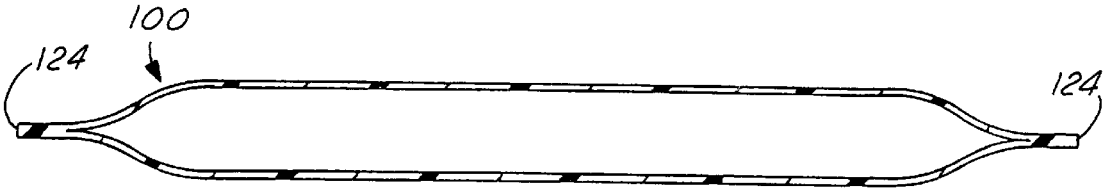
FIG. 12 is a cross sectional view taken along line 12—12 of FIG. 11.
Figure 13:
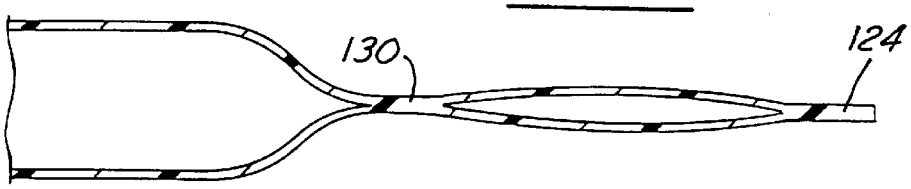
FIG. 13 is a cross sectional view taken along line 13—13 of FIG. 11.
Figure 14:
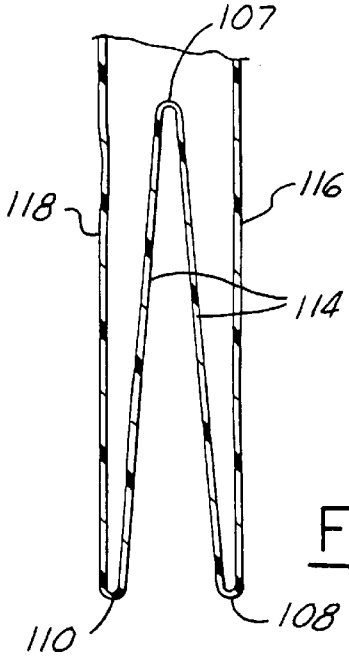
FIG. 14 is a cross sectional view taken along line 14—14 of FIG. 11.

As shown in FIGS. 10–15, in a second embodiment of the invention a so-called bottom gusseted liner 100 has a reduced perimeter or cross sectional area lower portion 102 constructed to be received within a container 12 and an increased or full perimeter or cross-sectional area upper portion 104 extending exteriorily of the container 12 to protect the container 12 as it is being filled or emptied. As shown in FIGS. 11 and 14, one method of forming the gusseted bottom of this liner 100 is by folding an elongate, rectangular blank 106 of material in half along a line 107 and reverse folding it along a pair of generally parallel, spaced apart lines 108, 110 to provide a gusseted panel 114 received between a pair of overlying flat panels 116, 118. Each flat panel 116, 118 has an upper edge 120, lower edge 108 or 110 and a pair of generally opposed side edges 124.

Figure 15:
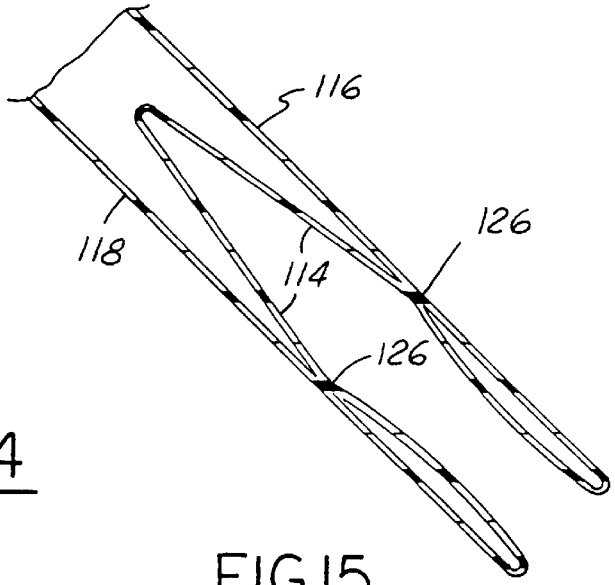
FIG. 15 is a cross sectional view taken along line 15—15 of FIG. 11.

As shown in FIGS. 11 and 15, the flat panels 116, 118 are heat sealed along canted lines 126 to its adjacent gusseted panel 114 without heat sealing the gusseted panel 114 to itself such as by disposing an isolating plate 54 within the gusset panel 114 as previously described. As shown in FIG. 13, the overlying flat panels 116, 118 are heat sealed together along a line 130 spaced from and parallel to the side edges 124 and extending from at least the point of intersection with the canted lines 126 up towards the upper portion 104 of the liner 100 and terminating at a transitional heat seal 132 canted at an acute included angle relative to the heat seal line 130 and extending to the side edges 124 below the upper edge 120 of the flat panels 116, 118. As shown in FIG. 12, at least along the upper portion 104 of the liner 100, the overlying flat panels 116, 118 are heat sealed together along their side edges 124 from the upper edge 120 to at least the transitional heat seal line 132 and preferably are heat sealed along their side edges 124 along the entire length of the liner

Figure 16:
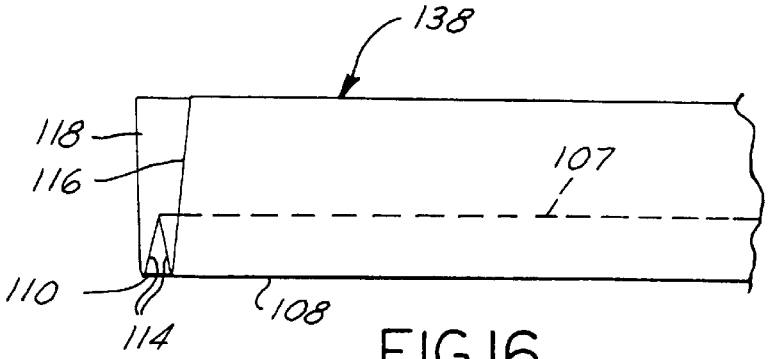
FIG. 16 is a perspective view of an elongate blank of material used to form a plurality of liners of FIG. 10.
Figure 17:
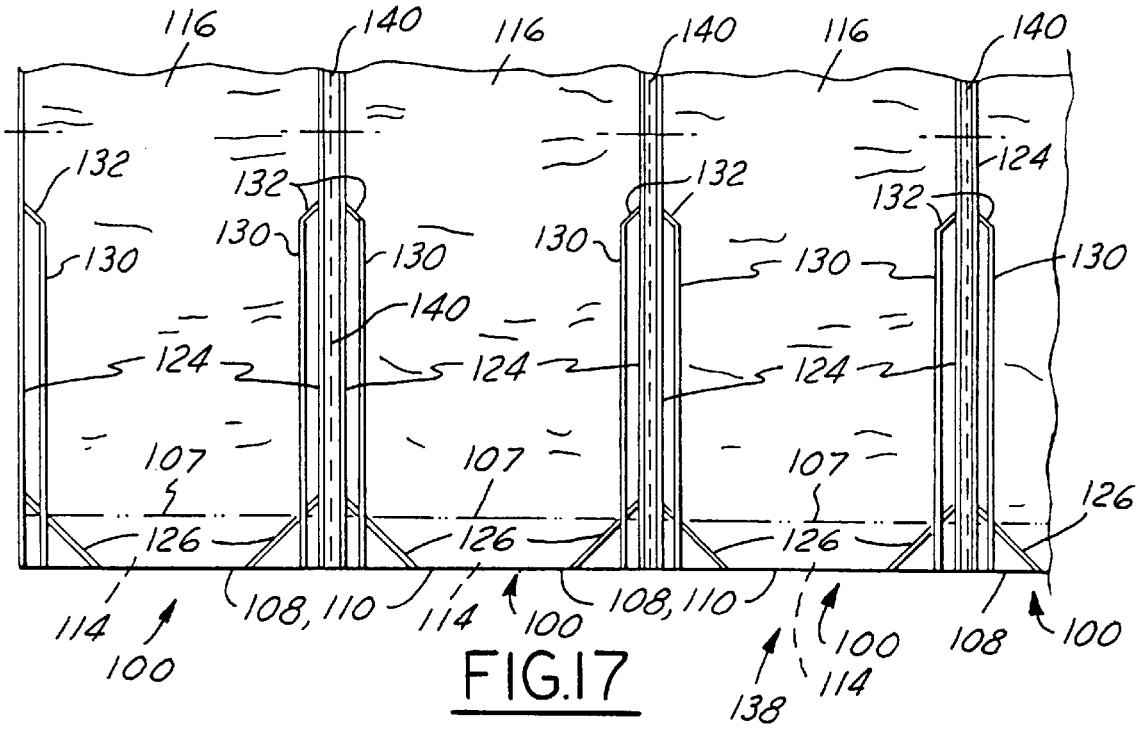
FIG. 17 is a plan view of a plurality of liners of FIG. 10 formed on the elongate blank of FIG. 16.

100. Further, if desired for ease of manufacturing, the heat seal lines 130 spaced from the side edges 124 may extend to the lower edge 108 or 110 or bottom wall 112 of the liner 100. When formed in this manner, and expanded as shown in FIG. 10, the bottom wall 112 is generally rectangular and interconnects four generally rectangular sidewalls 134 with only a pair of wasted material portions 136 extending from opposed sidewalls 134, generally midway within each of the opposed sidewalls 134 to form the reduced perimeter or cross-sectional area lower portion 102 of the liner 100. As shown in FIGS. 16 and 17, a plurality of these bottom gusseted liners 100 may be formed from an elongate web 138 of material gusset folded and sealed as described above and interconnected in side by side relation with a perforate line 140 formed between adjacent liners 100 to facilitate separating a liner 100 from the web 138.

The form fit liners 10, 100, provide a reduced perimeter or cross sectional area lower portion 14, 102 constructed to be received within a container 12 and a full perimeter or cross sectional area upper portion 16, 104 extending beyond the top of the container 12 to increase the protection of the container 12 from splashing or sloshing of the contents as the container 12 is being filled or emptied. Further, when used with insulated containers 12 having a significant wall thickness, and especially with insulated containers 12 having upper flaps 18, as shown in FIG. 1, the upper portion of the liners 10, 100 can be sufficiently large to be folded over the flaps 18 if desired. Even with a typical insulated ice cream container having a 1½ inch wall thickness, the upper portion of the liners 10, 100 can be made large enough to be folded over a 3 inch wall thickness if flaps 18 are present on the container 12 while the lower portion 14, 102 is small enough to easily form fit within the container 12. These liners 10, 100 may be formed on a continuous roll to facilitate manufacture, shipment, handling, dispensing and use of the liners 10, 100 and are form fit to their associated container 12 to facilitate inserting the liners 10, 100 within the container 12 and to reduce snagging or folding of the liners 10, 100 within the container 12 to improve their strength and reliability in use.

I claim:

1. A collapsible liner for a container comprising:

a plurality of sidewalls, each sidewall having at least one layer of a flexible material, a lower edge, an upper edge and side edges;

a bottom wall interconnecting the lower edges of the sidewalls;

at least two heat seals each joining together portions of two adjacent sidewalls, extending from generally adjacent the bottom wall and terminating between the bottom wall and upper edge of the two sidewalls and extending longitudinally generally parallel to, and spaced from, the side edges of the sidewalls, to define a lower portion of the liner having a reduced cross-sectional area along the longitudinal length of the heat seals and an upper portion of the liner defined between the upper edges of the sidewalls and the lower portion of the liner and having a greater cross-sectional area than the lower portion so that the lower portion of the liner is constructed to be received within the container with the upper portion having sufficient longitudinal length to extend out of the container to isolate the container as the liner is filled with and emptied of its contents.

2. The liner of claim 1 wherein when the liner is expanded and filled the bottom wall has at least two generally triangular portions each adjacent the lower edge of a sidewall and having side edges interconnected with adjacent portions of the bottom wall.

3. The liner of claim 1 wherein one pair of opposed sidewalls is folded to provide gusseted panels received between another pair of opposed sidewalls providing overlying flat panels and a heat seal interconnects the lower edge of each of the gusseted panels and the flat panels to form the bottom wall.

4. The liner of claim 3 which also comprises heat seals attaching the flat panels to the adjacent gusseted panels along lines canted at an acute included angle relative to the lower edges of the flat panels and intersecting the heat seals defining the lower portion of the liner.

5. The liner of claim 1 which has four interconnected sidewalls and four longitudinally extending heat seals, and each longitudinally extending heat seal connects adjacent sidewalls at a location spaced inwardly from the juncture between the adjacent sidewalls.

6. The liner of claim 5 which also comprises a transitional heat seal portion extending from each heat seal defining the lower portion of the liner to the juncture between adjacent sidewalls.

7. The liner of claim 1 wherein the upper portion is constructed of sufficient longitudinal length and perimeter to be folded over the container with a section of the upper portion of the liner received outside of the container and adjacent the exterior of the container.

8. The liner of claim 1 for a container having a plurality of flaps which may be closed to close the top of the container and opened to permit access to the interior of the container and when filling the container, the flaps are open and the upper portion of liner is constructed with sufficient longitudinal length to be folded so at least a section of the upper portion of the liner is outside of the container and covers at least a portion of the flaps.

9. The liner of claim 1 wherein the bottom wall comprises at least one uniform layer of material integral with each sidewall.

10. A collapsible liner for a container comprising:

four interconnected sidewalls, each sidewall having at least one layer of a flexible material, a lower edge, an upper edge and side edges;

a bottom wall interconnecting the lower edges of the sidewalls;

at least four heat seals each joining together portions of two adjacent sidewalls, extending from generally adjacent the bottom wall and terminating between the bottom wall and the upper edges of the two sidewalls and extending longitudinally generally parallel to the side edges of the sidewalls to define a lower portion of the liner having a reduced cross-sectional area along the longitudinal length of the heat seals and an upper portion of the liner defined between the upper edges of the sidewalls and the lower portion of the liner and having a greater cross-sectional area than the lower portion of the liner so that the lower portion of the liner is constructed to be received within the container and the upper portion of the liner has sufficient longitudinal length to extend out of the container to isolate the container as the liner is filled with and emptied of its contents.

11. A collapsible liner for a container having a plurality of flaps which may be closed to close the top of the container and opened to permit access to the interior of the container comprising:

at least four sidewalls, each sidewall having at least one layer of a flexible material, a lower edge, an upper edge and side edges;

a bottom wall interconnecting the lower edges of the sidewalls;

at least two heat seals each joining together portions of two adjacent sidewalls, extending from generally adjacent the bottom wall and terminating between the bottom wall and upper edge of the two sidewalls and extending longitudinally generally parallel to the side edges of the sidewalls to define a lower portion of the liner having a reduced cross-sectional area along the longitudinal length of the heat seals and an upper portion of the liner defined between the upper edges of the sidewalls and the lower portion of the liner and having a greater cross-sectional area than the lower portion so that the lower portion of the liner is constructed to be received within the container and the upper portion has sufficient longitudinal length to extend out of the container to isolate the container as the liner is filled with and emptied of its contents, and for filling the container when the flaps are open, the upper portion of the liner also being constructed with sufficient longitudinal length and perimeter to be folded so that at least a section of the upper portion of the liner overlies and is outside of the container and covers at least a portion of the flaps of the container.

* * * * *